US008887620B2

(12) United States Patent
MacDonald et al.

(10) Patent No.: US 8,887,620 B2
(45) Date of Patent: Nov. 18, 2014

(54) DIAPHRAGM INSTALLATION TOOL

(75) Inventors: Daniel L. MacDonald, Long Lake, MN (US); Adam K. Collins, Brooklyn Park, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 820 days.

(21) Appl. No.: 13/164,937

(22) Filed: Jun. 21, 2011

(65) Prior Publication Data

US 2011/0311378 A1 Dec. 22, 2011

Related U.S. Application Data

(60) Provisional application No. 61/357,394, filed on Jun. 22, 2010.

(51) Int. Cl.

| | |
|---|---|
| ***F01B 19/02*** | (2006.01) |
| ***F01L 15/20*** | (2006.01) |
| ***F04B 43/073*** | (2006.01) |
| ***B25B 27/14*** | (2006.01) |

(52) U.S. Cl.

CPC ..... *F04B 43/0736* (2013.01); *B25B 27/14* (2013.01)

USPC ..... 92/99; 92/96; 91/218; 29/888.02

(58) Field of Classification Search

USPC ..... 92/96, 97, 98 R, 99; 91/218; 29/281.5, 29/888.02, 888.021

See application file for complete search history.

(56) References Cited

U.S. PATENT DOCUMENTS

| | | | | |
|---|---|---|---|---|
| 2,501,294 | A * | 3/1950 | Sigvard | 92/99 |
| 2,679,209 | A * | 5/1954 | Fischer et al. | 92/97 |
| 6,142,749 | A * | 11/2000 | Jack et al. | 92/99 |

* cited by examiner

*Primary Examiner* — Michael Leslie

(74) *Attorney, Agent, or Firm* — Kinney & Lange, P.A.

(57) ABSTRACT

An air-driven dual diaphragm pump comprises a pump body with a first air passage leading to a first air cavity with a first diaphragm, a second air passage leading to a second air cavity with a second diaphragm, and a reciprocating shaft which connects the first and second diaphragms. A diaphragm installation tool for the dual diaphragm pump comprises a plate which fits atop the pump body. A groove in a surface of the plate opposite from and nonadjacent to the pump body extends from the location of the first air passage to the location of the second air passage. A hole located within the groove at the location of either the first air passage or the second air passage extends through the plate. Pressurized air entering the pump body is redirected by the groove and the hole to always enter the first air passage, rather than the second, thereby slowly filling the first air cavity and positioning the second diaphragm for installation.

21 Claims, 3 Drawing Sheets

DIAPHRAGM INSTALLATION TOOL

BACKGROUND

The present invention relates generally to diaphragm pumps, and more particularly to tools and methods for installing diaphragms for diaphragm pumps Diaphragm pumps are commonly used to pump fluids such as oil, grease, and water. Diaphragm pumps comprise at least one pumping chamber with a wall comprising a deformable diaphragm, a fluid inlet, and a fluid outlet. The diaphragm is driven to cyclically expand and contract the pumping chamber, while the fluid inlet and outlet are controlled by inlet and outlet check valves, respectively. Expansion of the pumping chamber creates a partial vacuum which draws fluid into the pumping chamber through the inlet, while the outlet check valve prevents fluid from being drawn into the pumping chamber against the pumping direction of the diaphragm pump. Contraction of the pumping chamber expels fluid from the pumping chamber through the outlet, while the inlet check valve prevents fluid from exiting the pumping chamber via the inlet. Diaphragms are conventionally clamped in position between adjacent sections of the diaphragm pump.

Dual diaphragm pumps comprise two connected diaphragms on opposite cycles. Each diaphragm forms a wall of a separate pumping chamber, such that a first pumping chamber fills while a second pumps, and vice versa. Air-driven dual-diaphragm pumps move both diaphragms with pressurized air which is alternatingly pumped and exhausted from air cavities behind each diaphragm.

Diaphragm installation for diaphragm pumps conventionally involves forcing diaphragms into installation positions such that they are under considerable strain, then clamping them into place on the diaphragm pump in a seal. Pump diaphragms are commonly constructed of rubber, Teflon, neoprene, plastic, and similar materials, and can require large forces to deform. Consequently, installation frequently requires specialized equipment capable of exerting large forces to position a diaphragm for installation. This installation process can cause damage to the diaphragm, and the necessary specialized equipment may include expensive, cumbersome clamps and vices. In addition, the large forces conventionally required to position pump diaphragms can pose safety risks.

SUMMARY

The present invention is directed towards a diaphragm installation tool for an air-driven dual diaphragm pump. The air-driven dual diaphragm pump comprises a pump body with a first air passage leading to a first air cavity with a first diaphragm, a second air passage leading to a second air cavity with a second diaphragm, and a reciprocating shaft that connects the first and second diaphragms. The diaphragm installation tool comprises a plate that fits atop the pump body. A groove in a surface of the plate opposite from and nonadjacent to the pump body extends from the location of the first air passage to the location of the second air passage. A hole located within the groove at the location of either the first air passage or the second air passage extends through the plate. Pressurized air entering the pump body is redirected by the groove and the hole to always enter the first air passage, rather than the second, thereby slowly filling the first air cavity and positioning the second diaphragm for installation.

DETAILED DESCRIPTION

Figure 1A:
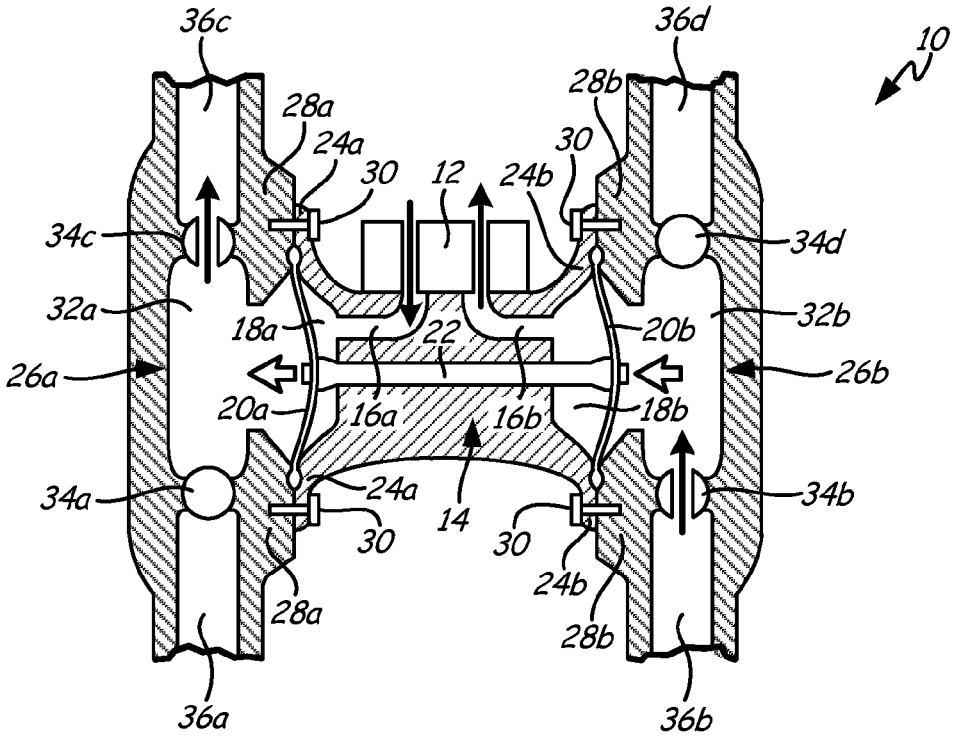
FIGS. 1*a* and 1*b* are simplified cross-sectional views of a diaphragm pump at two times during a pumping cycle.
Figure 1B:
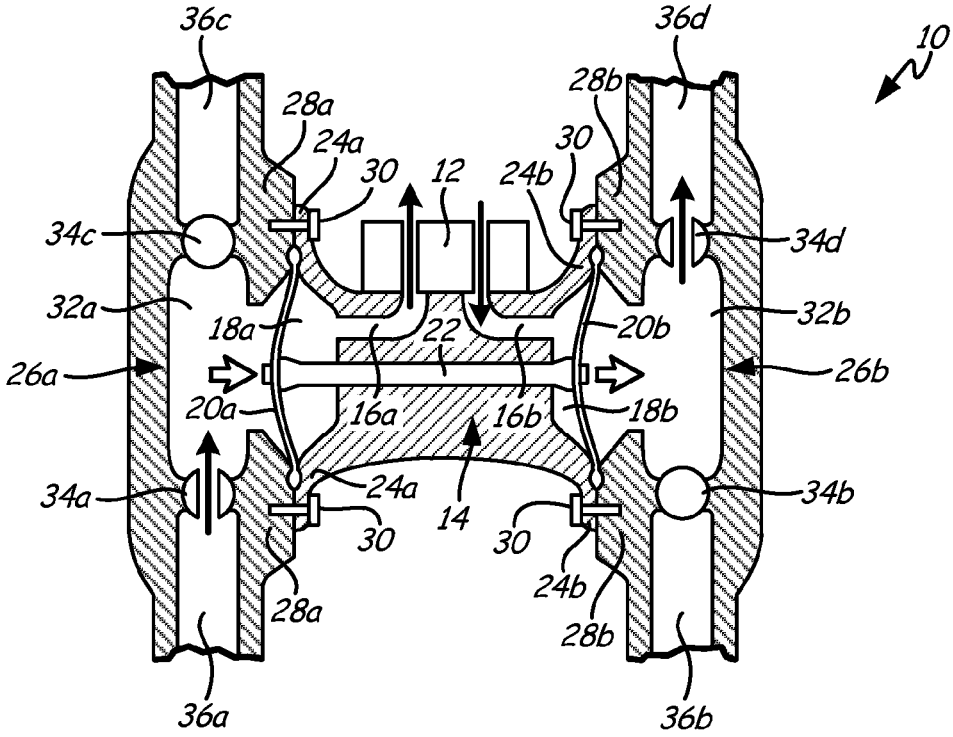

FIGS. 1*a* and 1*b* depict diaphragm pump 10, comprising main valve 12, pump body 14 (with air passages 16*a* and 16*b*), air cavities 18*a* and 18*b*, diaphragms 20*a* and 20*b*, shaft 22, air covers 24*a* and 24*b*, and pumping structures 26*a* and 26*b*, which include fluid covers 28*a* and 28*b*, fasteners 30, fluid cavities 32*a* and 32*b*, check valves 34*a*-34*d*, and fluid passages 36*a*-36*d*. FIG. 1*a* depicts a transitory position of diaphragm pump 10 wherein fluid cavity 32*a* has been filled with fluid, and fluid is beginning to be pumped from fluid cavity 32*a* into fluid passage 36*c*, and drawn from fluid passage 36*b* into fluid cavity 32*b*. FIG. 1*b* depicts a transitory position of diaphragm pump 10 wherein fluid cavity 32*b* has been filled with fluid, and fluid is beginning to be pumped from fluid cavity 32*b* into fluid passage 36*d*, and drawn from fluid passage 36*a* into fluid cavity 32*a*.

Diaphragm pump 10 is an air-driven dual diaphragm pump for a fluid such as oil or grease. Air is pumped into diaphragm pump 10 from an external pump (not shown) via main valve 12. Main valve 12 is an air valve which switches between two phases illustrated in FIGS. 1*a* and 1*b*. Diaphragm pump 10 operates in half-cycle phases. In the first phase (FIG. 1*a*), main valve 12 directs pressurized air into air passage 16*a*, and exhausts air from fluid passage 16*b*. In the second phase (FIG. 1*b*), main valve 12 directs pressurized air into air passage 16*b*, and exhausts air from fluid passage 16*a*. Air passages 16*a* and 16*b* are hollow channels through pump body 14, which is a rigid structure formed, for instance, from cast metal or hard plastic. Shaft 22 extends through a bore in pump body 14, and slides between two positions illustrated in FIGS. 1*a* and 1*b*. Shaft 22 is anchored to diaphragms 20*a* and 20*b*, which are made of a deformable material such as rubber, Teflon, neoprene, or plastic. Diaphragms 20*a* and 20*b* form air cavities 18*a* and 18*b*, respectively, with pump body 14. Air cavities 18*a* and 18*b* are spaces of variable size between diaphragms 20*a* and 20*b*, respectively, and pump body 14. Air cavities 18*a* and 18*b* expand and contract as air is pumped and exhausted via air passages 16*a* and 16*b*.

Diaphragms 20*a* and 20*b* are clamped in place between air covers 24*a* and 24*b* of pump body 14, and fluid covers 28*a* and 28*b* of pumping structures 26*a* and 26*b*, as shown. Fasteners 30 affix air covers 24*a* and 24*b* to fluid covers 28*a* and 28*b*, anchoring diaphragms 20*a* and 20*b*. Air covers 24*a* and 24*b* and fluid covers 28*a* and 28*b* are portions of pump body 14 and pumping structures 26*a* and 26*b*, respectively, which abut each other and form a seal with diaphragms 20*a* and 20*b*. Pumping structures 26*a* and 26*b* enclose fluid cavities 32*a* and 32*b*, which are spaces of variable size with one wall comprised of diaphragm 20*a* or diaphragm 20*b*, respectively. Pumping structures 26*a* and 26*b* need not be formed as single units, and may comprise multiple separate parts. As diaphragms 20*a* and 20*b* shift between the two states depicted in FIGS. 1*a* and 1*b*, fluid cavities 32*a* and 32*b* expand and contract. Fluid enters cavities 32*a* and 32*b* through check valves 34*a* and 34*b* from fluid passages 36*a* and 36*b*, respectively. Fluid exits fluid cavities 32*a* and 32*b* through check valves 34*c* and 34*d*, into fluid passages 36*c* and 36*d*, respectively. Check valves 34*a*-34*d* prevent fluid backflow opposite the pumping direction of diaphragm pump 10, and may take any conventional form, such as diaphragm check valves, swing check valves, and ball check valves. Fluid passages 36*a*-36*d* are hollow passages or tubes through pumping structures 26*a* and 26*b* which carry a pumped fluid such as oil or grease to and from fluid cavities 32*a* and 32*b*.

Diaphragm pump 10 pumps fluid from fluid passages 36*a* and 36*b* through fluid cavities 32*a* and 32*b* by expanding and contracting fluid cavities 32*a* and 32*b* through deformation of diaphragms 20*a* and 20*b*. Fluid passages 36*a* and 36*b* may carry identical fluids from a shared source, or may carry fluids—potentially different fluids—from different sources. These fluids are pumped as indicated by arrows in FIGS. 1*a* and 1*b*. Diaphragm pump 10 operates in phases determined by states of main valve 12, as described above. When diaphragm pump 10 operates in the first phase (FIG. 1*a*), pressurized air passes through air passage 16*a* to fill air cavity 18*a*, exerting pressure on diaphragm 20*a* which forces it to the left, contracting fluid cavity 32*a*. This contraction expels fluid from fluid cavity 32*a* into fluid passage 36*c* via check valve 34*c*. Check valve 34*a* prevents fluid from exiting fluid cavity 32*a* through fluid passage 36*a*. Diaphragm 20*a* is attached via shaft 22 to diaphragm 20*b*. As air cavity 18*a* fills and pushes diaphragm 20*a* leftward, shaft 22 draws diaphragm 20*b* leftward as well. Air is exhausted from air cavity 18*b* via air passage 16*b* as air cavity 18*b* contracts. The deformation of diaphragm 20*b* expands fluid cavity 32*b*, drawing fluid from fluid cavity 38*b* via check valve 34*b*. Check valve 34*d* prevents fluid from entering fluid cavity 32*b* through fluid passage 36*d*.

In the second phase of diaphragm pump 10 (see FIG. 1*b*), main valve 12 switches the direction of airflow through air passages 16*a* and 16*b*, pumping air into air cavity 18*b* and exhausting air from air cavity 18*a*. Diaphragms 20*a* and 20*b* are accordingly forced rightward, filling fluid cavity 32*a* from fluid passage 36*a*, and pumping fluid from fluid cavity 32*b* out into fluid passage 36*d*. Diaphragm pump 10 switches between the first and the second phase when a pilot switch (not shown) switches the state of main valve 12 from the first phase (FIG. 1*a*) to the second (FIG. 1*b*), or vice versa. This pilot switch may be any conventional mechanical, pneumatic, or electrical switch which causes main valve 12 to switch states in response to a change in position of diaphragm 20*a*, diaphragm 20*b*, or shaft 22. In some embodiments, the pilot switch comprises two pneumatic or mechanical pilot valves which toggle the state of main valve 12 in response to diaphragm 20*a*, diaphragm 20*b*, or shaft 22 reaching a maximum extension.

Diaphragm pump 10 can accept a wide variety of diaphragms 20*a* and 20*b* which may vary in dimension and flexibility. Diaphragms 20*a* and 20*b* may, for instance, vary slightly in undeformed radius, and can be constructed of pliable materials, or of rigid materials requiring large forces to deform. Diaphragms 20*a* and 20*b* can be installed by hand if diaphragms 20*a* and 20*b* either fall naturally into installation positions between air covers 24*a* and 24*b* and fluid cover 28*a* and 28*b*, or are easily deformed into position. In other cases, diaphragms 20*a* and 20*b* may require considerable force to deform into installation positions, as described below with respect to FIG. 2. A diaphragm installation tool capable of positioning a diaphragm for installation in these more difficult cases is provided below.

Figure 2:
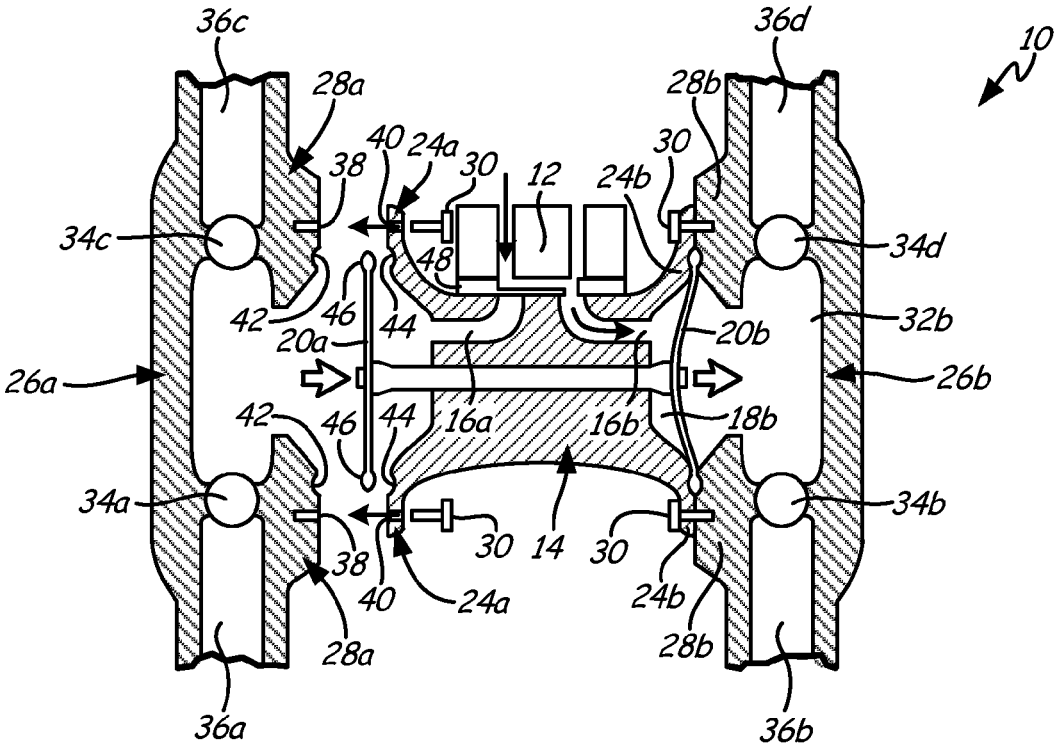
FIG. 2 is a partially exploded cross-sectional view of the diaphragm pump of FIG. 1, showing a diaphragm installation tool used to install a diaphragm.

FIG. 2 is a simplified cross-sectional view of diaphragm installation on diaphragm pump 10 using diaphragm installation tool 48. Diaphragm pump 10 comprises main valve 12, pump body 14 (with air passages 16*a* and 16*b*), air cavities 18*a* and 18*b*, diaphragms 20*a* and 20*b*, shaft 22, air covers 24*a* and 24*b*, pumping structures 26*a* and 26*b*, fluid covers 28*a* and 28*b*, fasteners 30, fluid cavities 32*a* and 32*b*, check valves 34*a*-34*d*, and fluid passages 36*a*-36*d*, as described with respect to FIGS. 1*a* and 1*b*. Fluid cover 28*a* includes fastener socket 38 and fluid cover groove 42, air cover 24*a* includes fastener hole 40 and air cover groove 44, and diaphragm 20*a* includes bead 46.

FIG. 2 depicts the same diaphragm pump 10 described above with respect to FIGS. 1*a* and 1*b*. In FIG. 2, pumping structure 26*a* is shown detached from pump body 24*a* for the installation of diaphragm 20*a*. Diaphragm 20*a* includes bead 46, a radially outer retaining bulge spanning at least a portion of the outer circumference of diaphragm 20*b*. In one embodiment, bead 46 forms an annular rim extending across the entirety of the outer circumference of diaphragm 20*b*. In other embodiments, bead 46 comprises a plurality of bulges distributed across the outer circumference of diaphragm 20*b*. Diaphragm 20*b* has a similar annular bead or rim.

Diaphragms for dual-diaphragm pumps are often installed and replaced in pairs. A first diaphragm can ordinarily be installed without any specialized tools, so long as the opposite diaphragm is not yet installed. FIG. 2 depicts a diaphragm 20*b* already installed, and diaphragm 20*b* in the process of installation. Diaphragm 20*b* may, for instance, be installed by attaching diaphragm 20*b* to shaft 22, and removing pumping structures 26*a* and 26*b*. Shaft 22 can then be slided back and forth through pump body 14 to adjust the position of diaphragm 20*b* relative to air cover 24*b* and fluid cover 28*b*, and in particular the position of bead 46 relative to fluid cover groove 42 and air cover groove 44. When bead 46 is aligned with both grooves, pumping structure 26*b* is brought into place, and air cover 24*b* is secured to fluid cover 28*b* with fastener 30 to clamp diaphragm 20*b* in place in a seal.

As mentioned previously, installing a second diaphragm can be more complicated. Once diaphragm 20*b* is installed, in some cases diaphragms 20*a* will align naturally for installation, such that bead 46 falls into place between fluid cover groove 42 of fluid cover 28*a* and air cover groove 44 of air cover 24*a*. In these cases, diaphragm 20*a* can be installed without using diaphragm installation tool 48. Often, however, diaphragm 20*a* will not align immediately for installation. Bead 46 of diaphragm 20*a* may, for instance, be located at a radius greater than the distance from shaft 22 to fluid cover groove 42 and air cover groove 44, such that diaphragm 20*a* must be deformed into a concave or convex shape to align diaphragm 20*a* for installation. In other cases, diaphragm 20*a* may be positioned too far from air cover 24*a* when diaphragm 20*b* not under strain, necessitating that diaphragm 20*b* be deformed to bring diaphragm 20*a* into an installation position.

As depicted in FIG. 2, diaphragm 20*a* must be drawn or deformed into position so that bead 46 aligns with air cover groove 44. Air cover groove 44 is a groove or plurality of grooves in air cover 24*a* which provides a recess for bead 46 of diaphragm 20*a*. Fluid cover 28*a* similarly features fluid cover groove 42, which serves the same purpose on the opposite side of diaphragm 20*a*. Once bead 46 of diaphragm 20*a* is aligned with air cover groove 44, fluid cover 28*a* and air cover 24*a* are clamped together such that bead 46 is retained in the space formed by fluid cover groove 42 and air cover groove 44, thereby securing diaphragm 20*a* in the position depicted in FIGS. 1*a* and 1*b*. Fasteners 30 are inserted through fastener holes 40 into fastener sockets 38 to anchor air cover 24*a* to fluid cover 28*a*. Fasteners 30 may, for instance, be bolts or screws which thread into threaded fastener sockets 38.

Diaphragm 20*a* is positioned relative to air cover 24*a* and fluid cover 28*a* using diaphragm installation tool 48. Diaphragm installation tool 48 is a plate which forms an airtight seal between main valve 12 and pump body 14, and which biases the direction of airflow from main valve 12, as described below with respect to FIGS. 3 and 4. As depicted, diaphragm installation tool 48 is inserted for diaphragm installation by removing main valve 12, positioning diaphragm installation tool 48 in a desired orientation, and then reattaching main valve 12 such that diaphragm installation tool 48 is clamped between main valve 12 and pump body 14. In other embodiments, diaphragm installation tool 48 may take any form which biases and restricts the flow of air into pump body 14, such as a replacement for main valve 12, or a removable cartridge insertable into the body of main valve 12 without detaching main valve 12 from pump body 14.

Diaphragm installation tool 48 overrides the directionality of airflow into pump body 14, directing air into air passage 16*b* and preventing any air from entering air passage 16*a*. Diaphragm installation tool 48 also restricts the flow rate of air into air cavity 18*b*, so that air cavity 18*b* fills slowly. As pressurized air fills air cavity 18*b*, diaphragm 20*b* is slowly forced to the right, drawing shaft 22 and diaphragm 20*a* to the right as well. Because diaphragm installation tool 48 diverts air into air passage 16*b* and air cavity 18*b* at much less than the full pumping airflow rate of diaphragm pump 10, a technician using installation tool 48 can precisely position diaphragm 20*b* (and therefore shaft 22 and diaphragm 20*a*) for installation of diaphragm 20*a*. As depicted, diaphragm 20*b* moves slowly rightward so long as pressurized air is provided to diaphragm pump 10 through installation tool 48, drawing shaft 22 and diaphragm 20*a* to the right as well. By shutting off the supply of pressurized air to diaphragm pump 10 when diaphragm 20*a* comes into position for installation (i.e. when bead 46 is aligned with fluid cover groove 42 and air cover groove 44), a technician can set up diaphragm 20*a* to be clamped between fluid cover 28*a* and air cover 24*a*. In one embodiment, diaphragm installation tool 48 is reversible: to install diaphragm 20*b*, diaphragm installation tool 48 can be inserted in an opposite direction to bias airflow towards air passage 16*a*, instead of air passage 16*b*.

In the depicted embodiment, diaphragm 20*a* is installed by inserting diaphragm installation tool 48 between main valve 12 and pump body 14, supplying main valve 12 with pressurized air until diaphragm 20*a* is in a correct installation position, and then clamping diaphragm 20*a* between air cover 24*a* and fluid cover 28*a*, and fastening air cover 24*a* to fluid cover 28*a* with fasteners 30. Installation tool 48 is then removed. More generally, diaphragm installation tool 48 may be any removable tool which restricts the flow of air, and biases that airflow towards only one of air cavity 18*a* or air cavity 18*b*. Diaphragm installation tool 48 is a simple, inexpensive component which allows diaphragm 20*a* to be aligned for installation using only the ordinary motion of shaft 22 and diaphragms 20*a* and 20*b*. This reduces the possibility of damage to diaphragm 20*a*, as well as safety risks associated with applying large, nonstandard forces on diaphragm 20*a* with vices or clamps.

Figure 3:
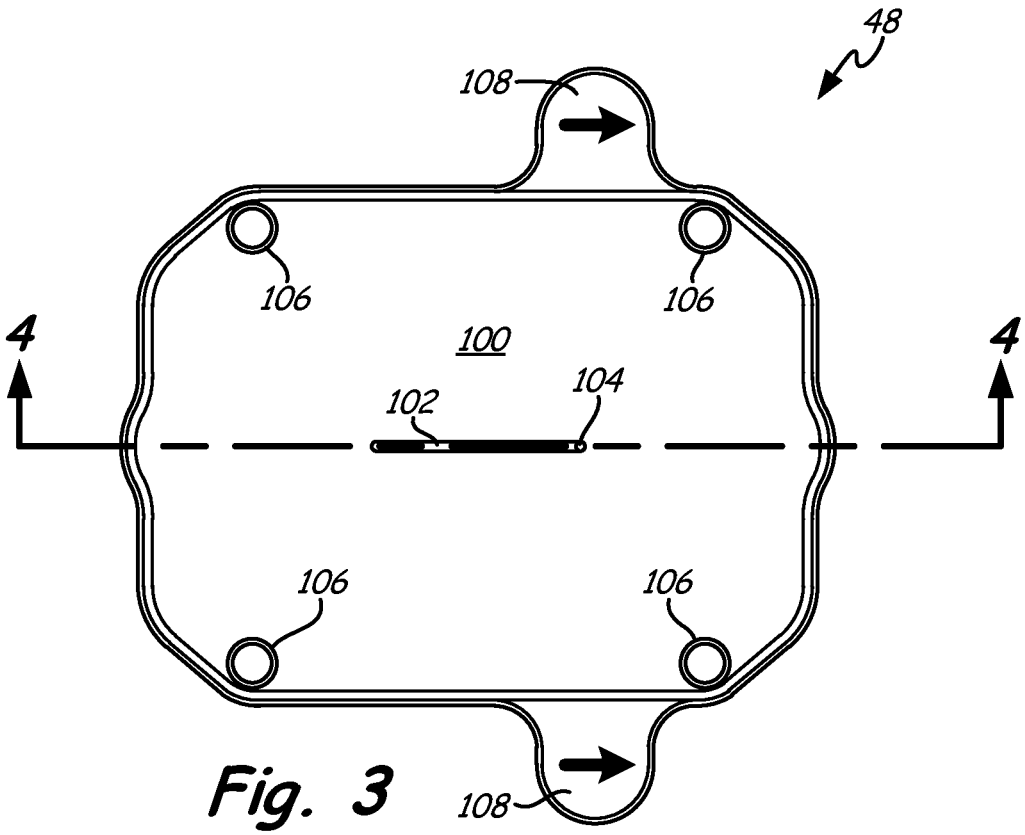
FIG. 3 is an overhead view of the diaphragm installation tool of FIG. 2.

FIG. 3 is an overhead view of one embodiment of diaphragm installation tool 48, comprising plate 100 with groove 102, hole 104, alignment points 106, and tabs 108. Plate 100 is formed of a deformable material such as rubber or soft plastic to form a compressive seal between main valve 12 and pump body 14. Plate 100 is substantially flat, but can include raised or recessed alignment points 106 which help to orient diaphragm installation tool 48 relative to main valve 12, pump body 14, or both. Alignment points 106 fit with corresponding protrusions or depressions in main valve 12, pump body 14, or both. Groove 102 is an elongated trench in the top surface of plate 100, and extends, when diaphragm installation tool 48 is in use, from the opening of air passage 16*a* to the opening of air passage 16*b*, as shown in FIG. 2. Hole 104 is a small-diameter passage through plate 100, located at one end of groove 102. Tabs 108 are tabs or flaps which extend from plate 100, and which are not covered by main valve 12 when diaphragm installation tool 48 is in position, as shown in FIG. 2. As depicted, tabs 108 are marked with arrows indicating the direction in which diaphragm installation tool 48 biases airflow.

Groove 102 directs air to hole 104, such that only air passage 16*b* receives pressurized air from main valve 12 while diaphragm 20*a* is being installed (see FIG. 2). Diaphragm installation tool 48 can be reversed to provide air only to air passage 16*a*, for the installation of diaphragm 20*b*. Diaphragm installation tool 48 biases airflow, such that air always enters pump body 14 via the selected air passage, regardless of the state of valve 12. The small diameter of hole 104 admits only a limited flow rate of air into air cavity 18*b*, allowing the position of diaphragms 20*a* to be carefully controlled by halting the supply of pressurized air to diaphragm installation tool 48 when diaphragm 20*a* is properly aligned, as described above with respect to FIG. 2. FIG. 3 also shows sectional line 4-4, which passes through groove 102.

Figure 4:
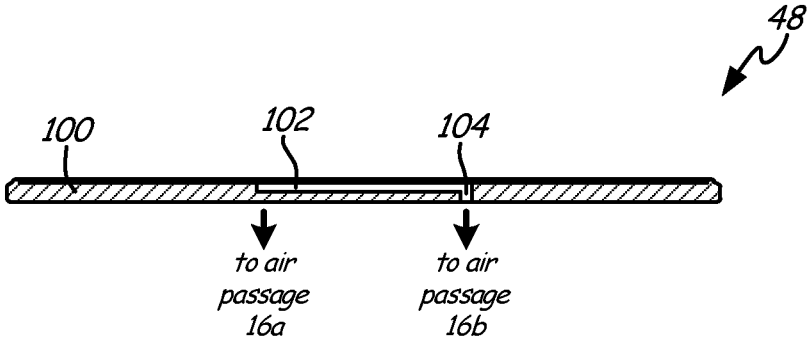
FIG. 4 is a cross-sectional view of the diaphragm installation tool of FIG. 3.

FIG. 4 is a cross-sectional view of diaphragm installation tool 48 through section line 4-4. FIG. 4 depicts plate 100, groove 102, and hole 104, as described with respect to FIG. 3. Groove 102 extends partway through plate 100, and provides a path for air to travel from either outlet of main valve 12, through hole 104, into air passage 16*b*.

Diaphragm installation tool 48 provides a simple, inexpensive solution to the problem of diaphragm installation. Diaphragm installation tool 48 redirects a fine stream of pressurized air into air cavity 16*b*, slowly filling cavity 16*b* and forcing diaphragm 20*b* rightward. This movement pulls shaft 22 and diaphragm 20*a* rightward as well, drawing diaphragm 20*a* into an installation position without applying harmful forces directly to diaphragm 20*a*. Diaphragm installation tool 48 uses the ordinary operational motion of diaphragms 20*a* and 20*b* and shaft 22 to align diaphragm 20*a* for installation, minimizing safety risks and avoiding damage to diaphragm 20*a*.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An air-driven dual diaphragm pump comprising:

a pump body having a bore, first air passage leading to a first air cavity with a first diaphragm, and a second air passage leading to a second air cavity with a second diaphragm;

a reciprocating shaft which passes through the bore and connects the first diaphragm and the second diaphragm; and a diaphragm installation tool comprising:

a plate which fits against the pump body; and an air passage in the plate that directs pressurized air into the first air passage to cause the first air cavity to fill and the first diaphragm to deflect so that the second diaphragm is moved into position for installation.

2. The air-driven dual diaphragm pump of claim 1, further comprising a main valve which is configured to alternatingly supply pressurized air to the first air passage and the second air passage, and wherein the diaphragm installation tool is positioned, in use, between the pump body and the main valve.

3. The air-driven dual diaphragm pump of claim 2, wherein the main valve is detachable and the diaphragm installation tool is positioned for use by removing the main valve, placing the diaphragm installation tool atop the pump body with the hole aligned with the first air passage, and reattaching the main valve atop the diaphragm installation tool, thereby clamping the diaphragm installation tool between the main valve and the pump body.

4. The air-driven dual diaphragm pump of claim 1, wherein the plate is formed of a compressible material which deforms to create an air seal which prevents air from escaping between the diaphragm installation tool and the pump body.

5. The air-driven dual diaphragm pump of claim 1, wherein the air passage comprises a hole and a groove in a surface of the plate opposite from and nonadjacent to the pump body, the groove extending from a location of the first air passage to a location of the second air passage, and the hole extending through the plate from the groove to the location of the first air passage.

6. The air-driven dual diaphragm pump of claim 5, wherein the hole has a narrow diameter relative to the diameters of the first and second air passages, to restrict the rate of airflow into the first air passage relative to a pumping airflow rate, so that the first diaphragm moves into position slowly.

7. The air-driven dual diaphragm pump of claim 1, wherein the first diaphragm is positioned by supplying pressurized air to the first air passage via the diaphragm installation tool until the second diaphragm is in position for installation, then cutting off the supply of pressurized air.

8. The air-driven dual diaphragm pump of claim 1, wherein the diaphragm installation tool is reversible to redirect pressurized air entering the pump body to always enter the second air passage, rather than the first thereby slowly filling the second air cavity and positioning the first diaphragm for installation.

9. A method for installing diaphragms of a dual diaphragm pump, the method comprising:

installing a first diaphragm, thereby sealing a first air cavity;

attaching a diaphragm installation tool to the diaphragm pump, the diaphragm installation tool biasing the direction of airflow such that air flowing through the diaphragm installation tool is directed to the first air cavity, rather than a second air cavity;

pumping pressurized air into the diaphragm pump via the diaphragm installation tool, thereby pressurizing the first air cavity and moving the first diaphragm and a second diaphragm connected to the first diaphragm; and clamping the second diaphragm in place at a clamping location, thereby sealing the second air cavity; and removing the diaphragm installation tool.

10. The method of claim 9, further comprising ceasing pumping pressurized air into the diaphragm pump before clamping, when the second diaphragm is positioned at the clamping location.

11. The method of claim 9, wherein the dual diaphragm pump comprises a pump body having a first air passage leading from the exterior of the pump body to the first air cavity, and a second air passage leading from the exterior of the pump body to the second air cavity, and wherein the diaphragm installation tool is attached to the exterior of the pump body to cover the first and second air passages.

12. The method of claim 11, wherein air flowing through the diaphragm installation tool always enters only the first air passage.

13. The method of claim 11, wherein attaching the diaphragm installation tool to the diaphragm pump comprises detaching a main valve from the pump body, inserting the diaphragm installation tool between the main valve and the pump body, and reattaching the main valve to the pump body, thereby clamping the diaphragm installation tool in place.

14. The method of claim 11, wherein the first air cavity is formed between the first diaphragm and the pump body, and the second air cavity is formed between the second diaphragm and the pump body, such that pumping pressurized air into the first air cavity expands the first air cavity by deforming the first diaphragm, causing it to pull the connected second diaphragm into the clamping location.

15. The method of claim 11, further comprising affixing fasteners to lock the clamped second diaphragm in place.

16. A diaphragm installation tool for an air-driven dual diaphragm pump with connected first and second diaphragms, the first and second diaphragms driven on opposite phases by pressurized airflow which alternates during pumping between driving the first diaphragm and driving the second diaphragm, the installation tool comprising an airflow structure which biases pressurized air to flow in an installation direction which drives the first pumping diaphragm, thereby drawing the second diaphragm into an installation position.

17. The diaphragm installation tool of claim 16, wherein the diaphragm installation tool is reversible to bias pressurized air to drive the second pumping diaphragm, rather than the first.

18. The diaphragm installation tool of claim 16, comprising:

a plate insertable between the dual diaphragm pump and a pressurized air valve, the pressurized air valve configured to alternatingly supply pressurized air through a first outlet to drive the first diaphragm, and through a second outlet to drive the second diaphragm;

a groove in the plate extending from the location of the first outlet to the location of the second outlet; and a hole which redirects air from the groove to drive the first diaphragm.

19. The diaphragm installation tool of claim 18, wherein the plate is formed of a material that creates a compression seal between the dual diaphragm pump and the pressurized air valve.

20. The diaphragm installation tool of claim 16, further comprising tabs for positioning, inserting, or removing the diaphragm installation tool, and which indicate the installation direction.

21. The diaphragm installation tool of claim 16, further comprising alignment points which fit with the dual diaphragm pump to align the diaphragm installation tool relative to the diaphragm pump.

* * * * *